US006903283B2

(12) United States Patent
Skarlupka et al.

(10) Patent No.: US 6,903,283 B2
(45) Date of Patent: Jun. 7, 2005

(54) PLUNGER RETENTION APPARATUS AND METHOD FOR SWITCH ENCLOSURES

(75) Inventors: Michael J. Skarlupka, Freeport, IL (US); Matthew J. Brose, Pecatonica, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/688,328

(22) Filed: Oct. 17, 2003

(65) Prior Publication Data

US 2005/0082149 A1 Apr. 21, 2005

(51) Int. Cl.[7] ..... H01H 15/00
(52) U.S. Cl. ..... 200/16 B; 200/341
(58) Field of Search ..... 200/16 B, 43.11, 200/43.16, 50.19, 556, 565, 5 A, 517, 520, 293, 329, 341, 344, 345, 43.07, 523, 296; 400/490, 491

(56) References Cited

U.S. PATENT DOCUMENTS 4,418,252 A * 11/1983 Daigle ..... 200/16 A
4,800,245 A * 1/1989 Murmann et al. ..... 200/345
4,916,277 A 4/1990 Tretter ..... 200/524
5,190,150 A 3/1993 Laue et al. ..... 200/341
5,203,448 A * 4/1993 Osada et al. ..... 200/517
5,280,148 A 1/1994 Cummins ..... 200/524
5,303,012 A 4/1994 Horlacher et al. ..... 335/253
5,396,030 A * 3/1995 Matsumiya et al. ..... 200/6 A
5,456,541 A * 10/1995 Ching-Shui ..... 400/490
5,670,759 A * 9/1997 Hsu ..... 200/5 A
5,672,857 A 9/1997 Frost et al. ..... 200/61.81
5,680,969 A * 10/1997 Gross ..... 222/494
5,710,397 A * 1/1998 Liao ..... 200/5 A
5,710,697 A * 1/1998 Cooke et al. ..... 363/21.11
5,744,769 A * 4/1998 Proctor et al. ..... 200/61.54
5,821,482 A * 10/1998 Ootani et al. ..... 200/5 A
6,056,457 A * 5/2000 Chao ..... 400/472
6,114,639 A 9/2000 Hall et al. ..... 200/16
6,204,463 B1 * 3/2001 Stringos ..... 200/520
6,269,691 B1 * 8/2001 Sowatzke et al. ..... 73/146.2
6,455,795 B1 * 9/2002 Murakami et al. ..... 200/345
6,600,122 B1 * 7/2003 Czarnecki et al. ..... 200/553
6,737,598 B1 * 5/2004 Allen et al. ..... 200/537
6,743,995 B2 * 6/2004 Groves et al. ..... 200/527

* cited by examiner

*Primary Examiner*—Elvin G. Enad
*Assistant Examiner*—Lisa Klaus
(74) *Attorney, Agent, or Firm*—Kris T. Fredrick; Kermit D. Lopez; Luis M. Ortiz

(57) ABSTRACT

A switch enclosure apparatus and method are disclosed. An enclosure can be provided, wherein the enclosure comprises a plurality of walls from which a cavity can be formed. A plunger or other actuating mechanism can also be provided comprising one or more key portions, wherein said plunger is partially located and maintained within said cavity of said enclosure. Additionally, one or more slots can be formed from one or more walls, (e.g., side walls, top wall, bottom wall, etc.) of said enclosure for engaging said one or more of the key portions of said plunger. The plunger itself is shaped in the form of a shaft.

14 Claims, 10 Drawing Sheets

PLUNGER RETENTION APPARATUS AND METHOD FOR SWITCH ENCLOSURES

TECHNICAL FIELD

Embodiments are generally related switch enclosures and other mechanically actuated devices. Embodiments are also related to plunger and other input mechanisms utilized in switching devices. Embodiments are also related to switch enclosures for maintaining plunger and other input mechanisms.

BACKGROUND OF THE INVENTION

Many types of switch mechanisms are utilized in residential, commercial, industrial and military applications. A particular application of switch mechanisms of this type relate to pushbutton switches that comprise a plunger that is moveable relative to a base along an axis and which causes actuation of switching components when the plunger is depressed. Typically, the plunger is connected to a button that is depressible by a human finger. Some switch mechanisms cause actuation of a switch upon each depression of the button and plunger while other switch applications, referred to as alternate action devices, actuate on one push and release of the button and undo the actuation on a subsequent push and release of the button.

In many switch designs and other mechanically actuated devices, the plunger is therefore utilized as the input mechanism to force some other action within the surrounding enclosure (i.e., case or housing). Plungers come in all different shapes and sizes but are usually retained in their respective enclosures by similar means. In most cases, a spring or similar feature can provide resistance to the actual movement of the plunger into the enclosure. One of the problems with conventional switch enclosure designs is that the plunger can easily move out of the necessary position for actuating or maintaining the switch. If the plunger moves, even slightly, the switch will not function properly. It is therefore desirable to provide a means by which the plunger can be retained and cannot fall out of the enclosure either through vibration or by otherwise trying to extract the plunger in the opposite direction of its intended action.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide for an improved mechanically actuated device.

It is another aspect of the present invention to provide for an improved switch enclosure and input mechanism, such as a plunger.

It is still another aspect of the present invention to provide an improved apparatus and method for maintaining a plunger within a switch enclosure.

The aforementioned aspects of the invention and other aspects and advantages can now be achieved as described herein. A switch enclosure apparatus and method are disclosed. An enclosure can be provided, wherein the enclosure comprises a plurality of walls from which a cavity and one or more slots are formed. A plunger is also provided comprising one or more key portions, wherein said plunger is partially located and maintained within said cavity of said enclosure. Additionally, one or more slots can be formed from one or more walls, (e.g., side walls, top wall, bottom wall, etc.) of said enclosure for engaging said one or more of the key portions of said plunger. The plunger itself is shaped in the form of a shaft.

At least one wall (e.g., a side wall) can comprise an opening, which can be covered by a removable mating cover. Additionally, a protruding portion can be configured from the mating cover for engaging one or more of the slots. A bushing can also be formed from one of the walls (e.g., top wall or top side) of the enclosure, wherein the bushing surrounds the plunger when the plunger is placed into the cavity of the enclosure. Additionally, first and second slots can be provided wherein the second slot is positioned at an angle to the first slot, such that a key portion is aligned initially with the first slot and the plunger is thereafter inserted through the bushing, followed by a rotation of the plunger until the key portion is aligned with the second slot, thereby providing a surface against which the plunger can stop.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment and are not intended to limit the scope of the invention.

In many switch designs and other mechanically actuated devices, a plunger can be used as the input mechanism to force some other action within the surrounding enclosure. In most cases a spring or similar feature provides resistance to the actual movement of the plunger into the enclosure. It is necessary to provide a means by which the plunger is retained and cannot fall out of the enclosure either through vibration or by otherwise trying to extract the plunger in the opposite direction of its intended action. Plungers come in all different shapes and sizes but are usually retained in their respective enclosures by similar means.

Figure 1:
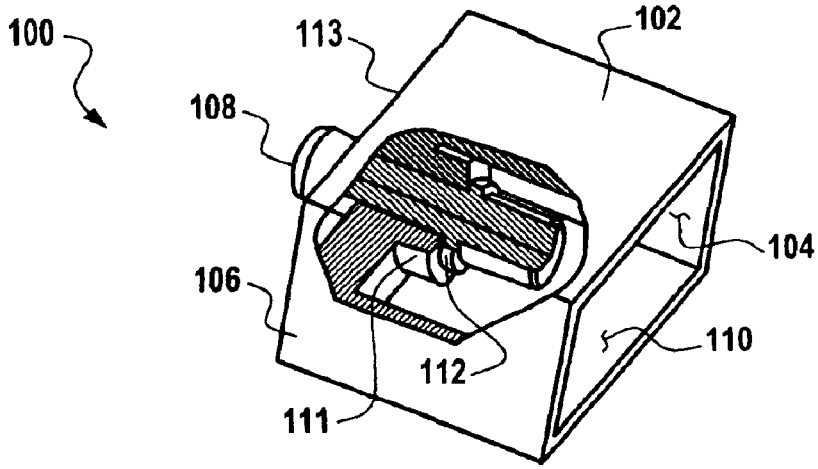
FIG. 1 illustrates a perspective view of a plunger and a enclosure.

FIGS. 1–5 illustrate varying views of a plunger 108 and an enclosure 100. FIG. 1 illustrates a perspective view of the plunger 108 and the enclosure 100. Enclosure 100 generally includes a top portion or topside 113 and walls 104, 106 and 110, 102. In FIG. 1, plunger 108 is shown located within enclosure 100. Plunger 108 generally includes a retaining ring or section 112, while enclosure 100 includes a bushing wall 111, which comes into contact with retaining ring or section 112 of plunger 108. Wall 102 is generally located opposite wall 110, while wall 104 is located opposite wall 106. A top wall or topside 113 of enclosure 100 is also shown in FIG. 1.

Figure 2:
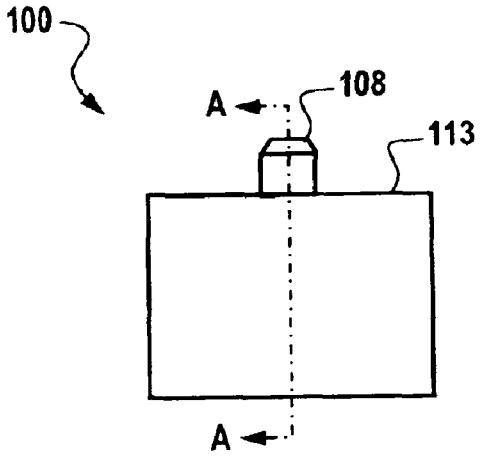
FIG. 2 illustrates a sectional A—A view of the plunger and the enclosure illustrated in FIG. 1.
Figure 3:
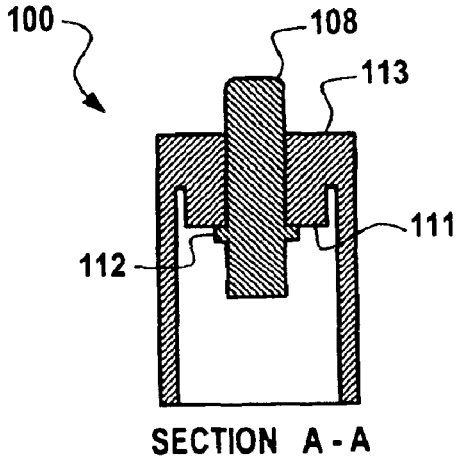
FIG. 3 illustrates a side sectional A—A view of the plunger and the enclosure illustrated in FIG. 1.
Figure 4:
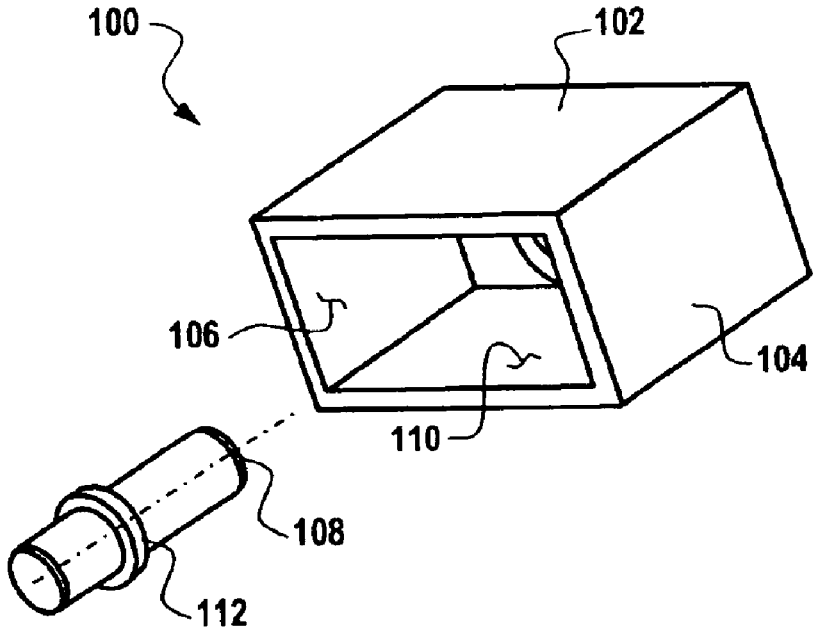
FIG. 4 illustrates a bottom perspective of the plunger and the enclosure the illustrated in FIG. 1.
Figure 5:
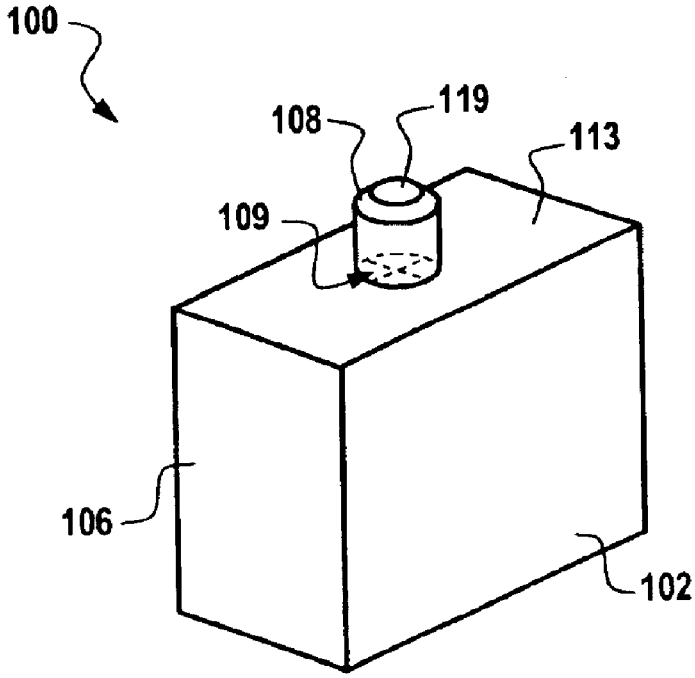
FIG. 5 illustrates a side perspective view of the plunger and the enclosure illustrated in FIG. 1.

FIG. 2 illustrates a sectional A—A view of the plunger 108 and the enclosure 100 illustrated in FIG. 1. The topside 113 is shown in FIG. 2 and a portion of plunger 108 protruding through topside 113 of enclosure 100. FIG. 3 illustrates a side sectional A—A view of the plunger 108 and the enclosure 100 illustrated in FIG. 1. FIG. 4 illustrates a bottom perspective of the plunger 108 and the enclosure 100 illustrated in FIG. 1. Walls 102, 104, 106 and 110 are also shown in FIG. 4, along with retaining ring or section 112 of plunger 108. FIG. 5 illustrates a side perspective view of the plunger 108 and the enclosure 100 illustrated in FIG. 1.

Walls 102 and 106 are also shown in FIG. 5, along with the top wall or topside 113. Diameter 109 is also shown in FIG. 5, which represents the diameter of the opening through which plunger 108 protrudes through topside 113 of enclosure 100. Plunger 108 can be configured to include a central portion 119 thereof. Note that in FIGS. 1–5 herein, identical or similar parts or elements are indicated by identical reference numerals. FIGS. 1–5 thus represent varying view of the same enclosure 100 and plunger 108.

FIGS. 1–5 indicate that the plunger 108 itself includes an area or section 112 (i.e., a retaining ring) that has a diameter larger than the bushing diameter 109 of the enclosure 100. The plunger 108 is thus inserted from inside the enclosure 100 and the larger diameter section 112 on the plunger 108 stops against the bushing wall 111, preventing it from coming out through the topside 113 of the enclosure 100. In cases where the enclosure 100 is split in half, the plunger 108 can be assembled in a top down fashion. These are simple methods with no extra parts necessary to accomplish the task.

In certain situations, however, the design of the enclosure may force the plunger 108 to be inserted from outside the enclosure 100. An example would be if the plunger 108 is too long to assemble from inside the enclosure 100 or if a portion of the plunger 108 that resides outside the enclosure 100 has a larger diameter than the bushing diameter 109 of the enclosure 100. In these cases, a plunger stop can be added to the plunger 108 after its initial assembly into the enclosure 100. An example would be the installation of a snap ring or other part that increases the diameter of the plunger 108 in the desired area or section 112 along the plunger 108 to allow it to act as a plunger stop. This method is very effective, but adds at least one additional part and increases complexity to the assembly.

Figure 6:
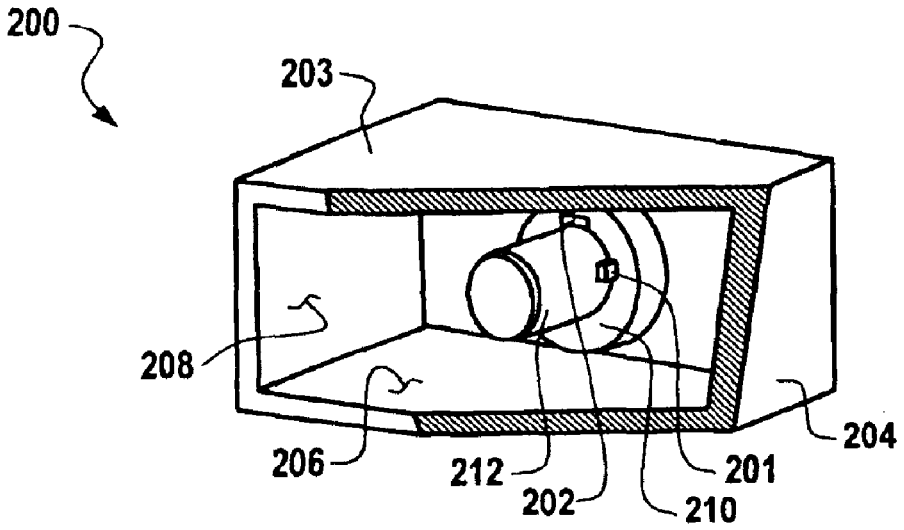
FIG. 6 illustrates bottom perspective view of a plunger and a enclosure.
Figure 7:
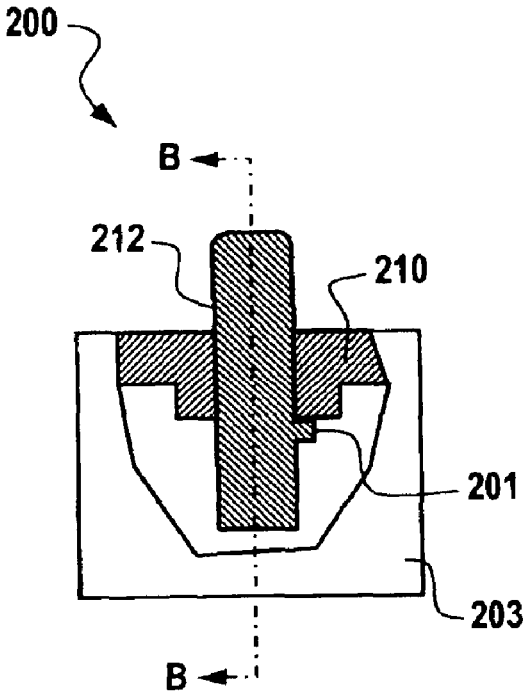
FIG. 7 illustrates a sectional B—B view of the plunger and the enclosure illustrated in FIG. 6.
Figure 8:
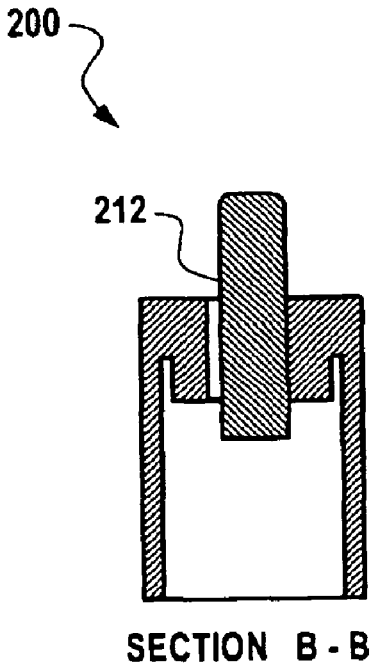
FIG. 8 illustrates a side sectional B—B view of the plunger and the enclosure illustrated in FIG. 6.
Figure 9:
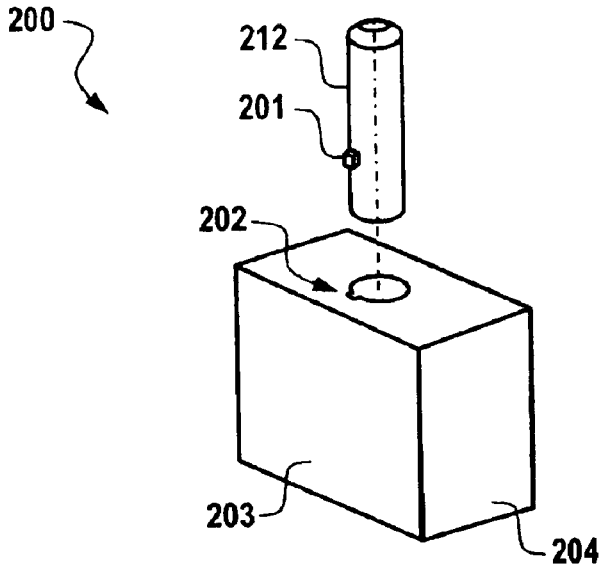
FIG. 9 illustrates a side perspective view of the plunger and the enclosure illustrated in FIG. 6.
Figure 10:
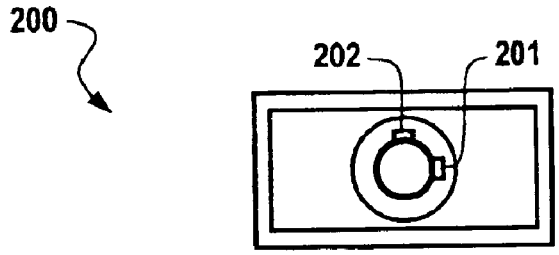
FIG. 10 illustrates a bottom view of the plunger and the enclosure illustrated in FIG. 6.
Figure 11:
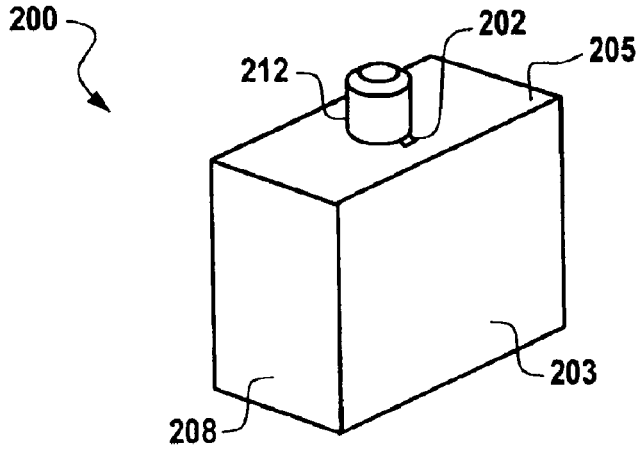
FIG. 11 illustrates a side perspective view of the plunger and the enclosure illustrated in FIG. 6.

FIGS. 6–11 illustrate varying views of a plunger 212 and an enclosure 200. The plunger 212 of FIGS. 6–11 is analogous to the plunger 108 of FIGS. 1–5, with modifications thereof. FIG. 6 illustrates a bottom perspective view of plunger 212 and the enclosure 200. FIG. 7 illustrates a sectional B—B view of the plunger 212 and the enclosure 200 illustrated in FIG. 6. FIG. 8 illustrates a side sectional B—B view of the plunger 212 and the enclosure 200 illustrated in FIG. 6. FIG. 9 illustrates a side perspective view of the plunger 212 and the enclosure 200 illustrated in FIG. 6. FIG. 10 illustrates a bottom view of the plunger 212 and the enclosure 200 illustrated in FIG. 6. Likewise, FIG. 11 illustrates a side perspective view of the plunger 212 and the enclosure 200 illustrated in FIG. 6. Note that in FIGS. 6–11 herein, similar or identical parts or elements are indicated by identical reference numerals.

In FIGS. 6–11, plunger 212 includes a protrusion 201 along the shaft of plunger 212. Such a protrusion 201 acts as a "key". The enclosure 200 is configured to include a complimentary "keyway slot" 202, which allows the plunger 212 to be inserted from outside the enclosure 200. The plunger 212 can be then rotated to allow the key or protrusion 201 from the plunger to stop on the bushing wall 210 of the enclosure 200. This approach eases assembly by eliminating the need for extra parts such as the retaining ring 112 shown in FIGS. 1–5. The problem with this method, however, is that through shock, vibration or physical rotation of the plunger 212, the key or protrusion 201 configured on the plunger 212 can be forced to once again align itself with the keyway slot 202 in the enclosure 200 allowing it to disengage itself from the enclosure 200.

FIGS. 12–17, FIGS. 18–22, and FIGS. 23–29 respectively represent three alternative embodiments of the present invention. FIGS. 12–17 represent a preferred embodiment, while FIGS. 18–22 and FIGS. 23–29 illustrate alternative embodiments. The three embodiments described below generally can be implemented to accomplish the task of retaining a plunger for situations in which the plunger can only be inserted from outside the enclosure due to necessary design constraints.

Figure 12:
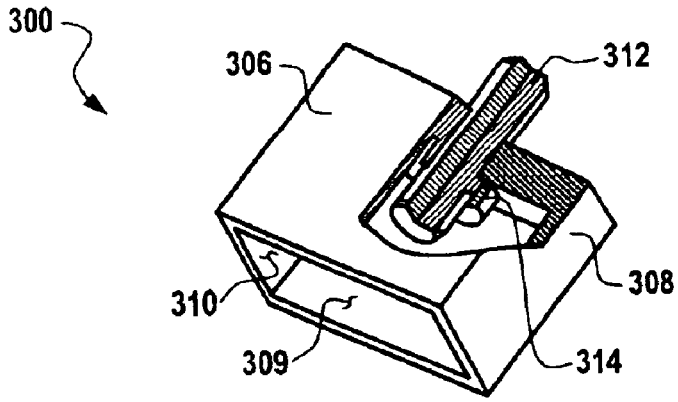
FIG. 12 illustrates a side perspective partial cut-away view of a plunger and a enclosure, in accordance with a preferred embodiment.

Note that in FIGS. 12–17 herein, similar or identical parts are indicated by identical reference numerals. FIG. 12 illustrates a side perspective partial cut-away view of a plunger 312 and an enclosure 300, in accordance with a preferred embodiment. Enclosure 300 includes a wall 306 which is located opposite a wall 309. Enclosure 300 also includes a wall 308, which is located opposite a wall 310. Enclosure 300 additionally includes a bushing or bushing wall 314.

Figure 13:
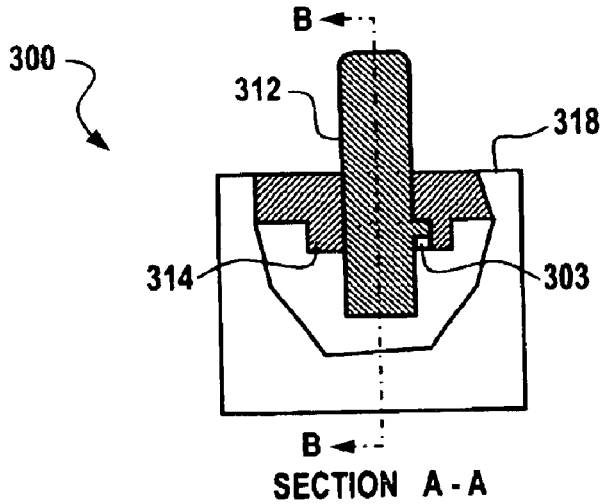
FIG. 13 illustrates a sectional B—B view of the plunger and the enclosure illustrated in FIG. 12, in accordance with a preferred embodiment.
Figure 14:
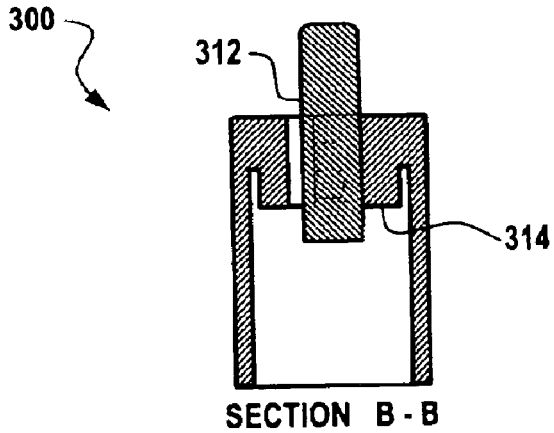
FIG. 14 illustrates a side sectional B—B view of the plunger and the enclosure illustrated in FIG. 12, in accordance with a preferred embodiment.
Figure 15:
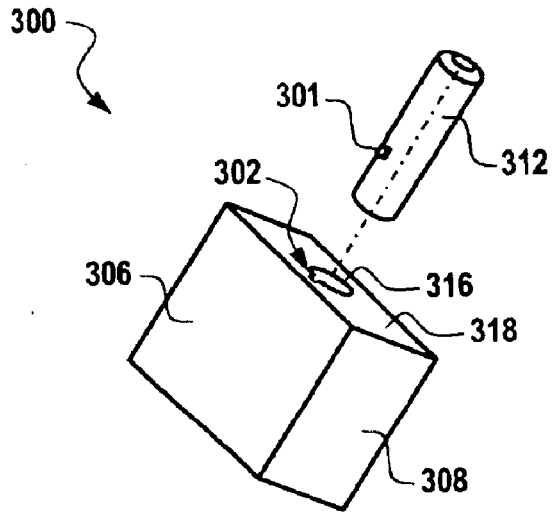
FIG. 15 illustrates a side perspective view of the plunger and the enclosure illustrated in FIG. 12, in accordance with a preferred embodiment.

FIG. 13 illustrates a sectional B—B view of the plunger 312 and the enclosure 300 illustrated in FIG. 12, in accordance with a preferred embodiment. FIG. 13 also illustrates a topside 318 of enclosure 300 and a slot 303 formed from bushing wall 314. FIG. 14 illustrates a side sectional B—B view of the plunger 312 and the enclosure 300 illustrated in FIG. 12, in accordance with a preferred embodiment. FIG. 15 illustrates a side perspective view of the plunger 312 and the enclosure 300 illustrated in FIG. 12, in accordance with a preferred embodiment. The view depicted in FIG. 15 illustrates the plunger 312 prior to entry to enclosure 300 through a hole 316, which is configured from top wall or topside 318. Walls 306 and 308 are also depicted in FIG. 15. Also shown in FIG. 15 is a key portion or plunger key 301.

Figure 16:
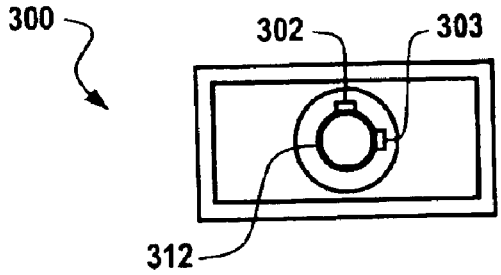
FIG. 16 illustrates a bottom view of the plunger and the enclosure illustrated in FIG. 12, in accordance with a preferred embodiment.
Figure 17:
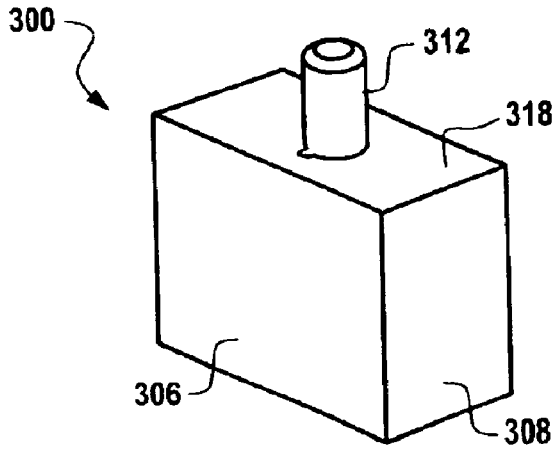
FIG. 17 illustrates a side perspective view of the plunger and the enclosure illustrated in FIG. 12, in accordance with a preferred embodiment.

FIG. 16 illustrates a bottom view of the plunger 312 and the enclosure illustrated in FIG. 12, in accordance with a preferred embodiment. In FIG. 16, two slots are indicated, including slot 302 and slot 303. FIG. 17 illustrates a side perspective view of the plunger 312 and the enclosure 300 illustrated in FIG. 12, in accordance with a preferred embodiment. FIG. 17 also illustrates walls 308, 306 and topside 318.

FIGS. 12–17 thus indicate a configuration that is analogous to that described herein with respect to FIGS. 6–11, except that an additional keyway slot is added to the enclosure 300 originating from within the enclosure 300, but not fully extending through the bushing wall 314 to the outside. This additional keyway slot can be positioned at an angle (e.g., 45°, 60°, 90°, etc.) to the original slot 302, which is analogous to the slot 202 depicted in FIGS. 6–11.

In the configuration of FIGS. 12–17, the plunger key 301 can be aligned with the first keyway slot 302, and then the plunger 312 can be inserted all the way through the bushing 314 (i.e., bushing wall) of enclosure 300, and then rotated until the plunger key 301 is aligned with the secondary keyway slot 303. This slot 303 does not fully extend to the outside of the enclosure 300, and thus provides a surface for the plunger key 301 to stop against. The depth of the secondary slot 303 should be slightly longer than the maximum plunger travel to prevent the plunger 312 from being able to rotate back to the point where the plunger key 301 is again aligned with the first keyway slot 302 and can become disengaged from the enclosure 300.

Figure 18:
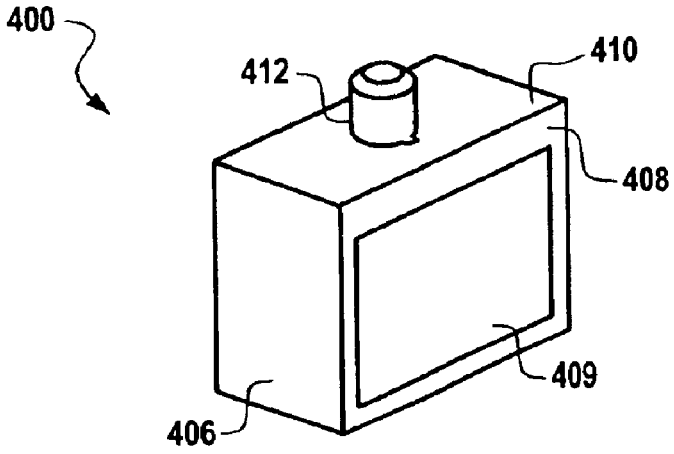
FIG. 18 illustrates a side perspective view of a plunger and an enclosure, in accordance with an alternative embodiment.

FIGS. 18–22 represent a modification to the embodiment depicted in FIGS. 12–17. In FIGS. 18–22, similar or identical parts are indicated by identical reference numerals. Note that enclosure 400 of FIGS. 18–22 is analogous to enclosure 300 of FIGS. 12–17, except that enclosure 400 is modified with the extra features depicted in FIGS. 18–22. FIG. 18 illustrates a side perspective view of a plunger 412 and the enclosure 400, in accordance with an alternative embodiment. In FIG. 18, a side 406 is shown, along with a side 408. A topside 410 is also shown through which a portion of plunger 412 protrudes external from enclosure 400. A mating cover 409 is also shown in FIG. 18. Such a cover 409 can be removed and then re-attached to enclosure 400.

Figure 19:
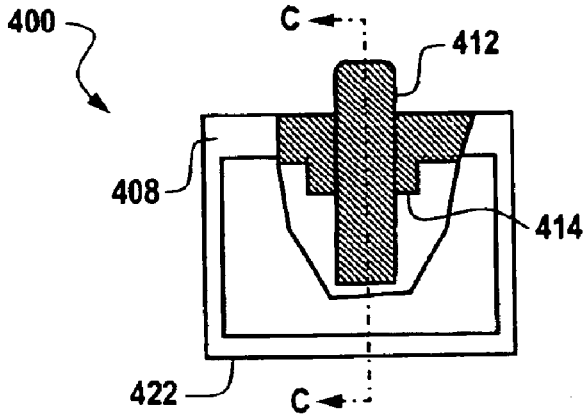
FIG. 19 illustrates a sectional C—C view of the plunger and the enclosure illustrated in FIG. 18, in accordance with an alternative embodiment.
Figure 20:
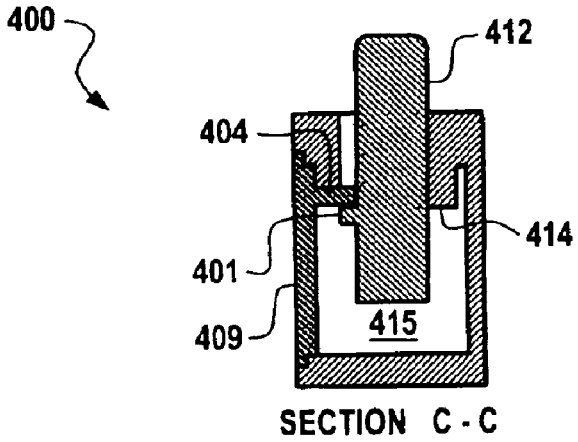
FIG. 20 illustrates a side sectional C—C view of the plunger and the enclosure illustrated in FIG. 18, in accordance with a preferred embodiment.

FIG. 19 illustrates a sectional C—C view of the plunger and the enclosure illustrated in FIG. 18, in accordance with an alternative embodiment. In FIG. 19, a bushing wall or bushing 414 is depicted, through which plunger 412 is positioned within enclosure 400. FIG. 20 illustrates a side sectional C—C view of the plunger 412 and the enclosure 400 illustrated in FIG. 18, in accordance with a preferred embodiment. FIG. 20 additionally depicts the mating cover 409, which includes a protruding feature 404. A bottom side or bottom wall 422 of enclosure 400 is also indicated in FIGS. 19 and 20. FIG. 20 specifically indicates a central portion or cavity 415 of enclosure 400. Additionally, plunger 412 includes a plunger key 401.

Figure 21:
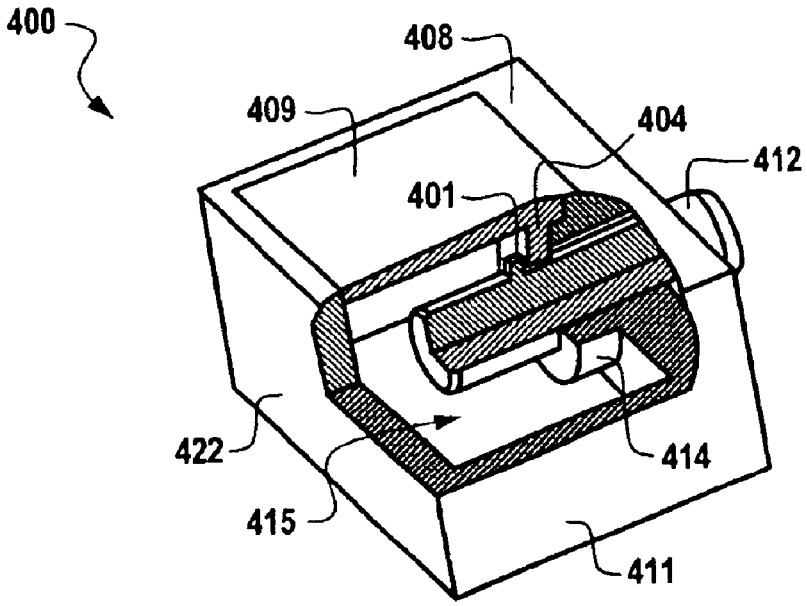
FIG. 21 illustrates a side perspective partial cut-away view of the plunger and the enclosure illustrated in FIG. 18, in accordance with an alternative embodiment.
Figure 22:
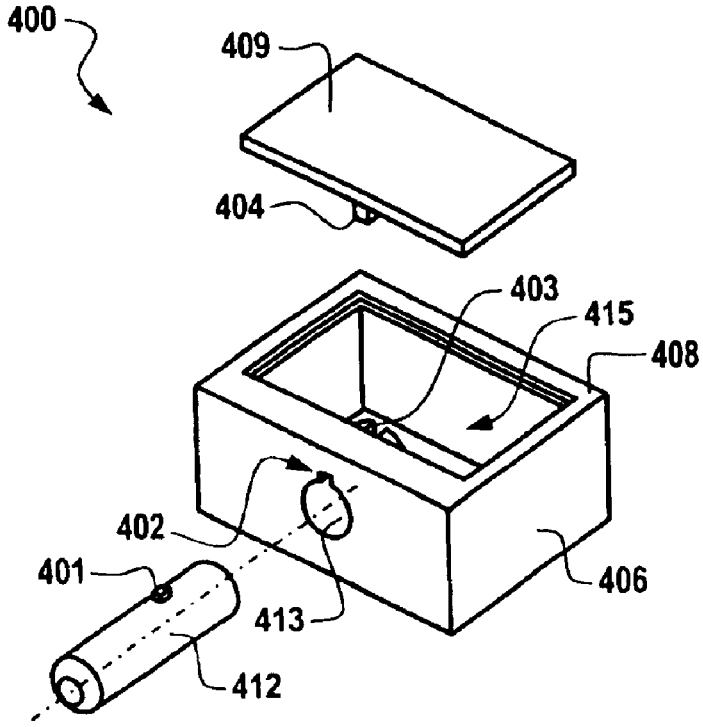
FIG. 22 illustrates a side perspective view of the plunger and the enclosure illustrated in FIG. 18, in accordance with an alternative embodiment.

FIG. 21 illustrates a side perspective partial cut-away view of the plunger 412 and the enclosure 400 illustrated in FIG. 18, in accordance with an alternative embodiment. In FIG. 21, mating cover 409 and protruding feature 404 thereof are also depicted, along with bushing 414, wall 408, bottom wall 422 and cavity 415. A wall 411 is also shown in FIG. 21, which is located opposite the wall 406 depicted in FIGS. 18 and 22. FIG. 22 illustrates a side perspective view of the plunger 412 and the enclosure 400 illustrated in FIG. 18, in accordance with an alternative embodiment.

In addition to the presence of a keyway slot 402 configured in the bushing 414, an additional slot 403 can be configured, which is positioned orthogonal to the plunger/bushing axis. As indicated in FIGS. 18–22, the slot 403 can generally extend to the plunger stop surface at the bottom of the bushing 414 in the enclosure 400. The mating cover 409 generally includes the protruding feature 404 which can fill this second slot 403 and thereby prevent the plunger 412 from being able to back out of its intended position even if rotated to align the plunger key 401 with the first slot 402 passing through the entire length of the bushing 414.

Figure 23:
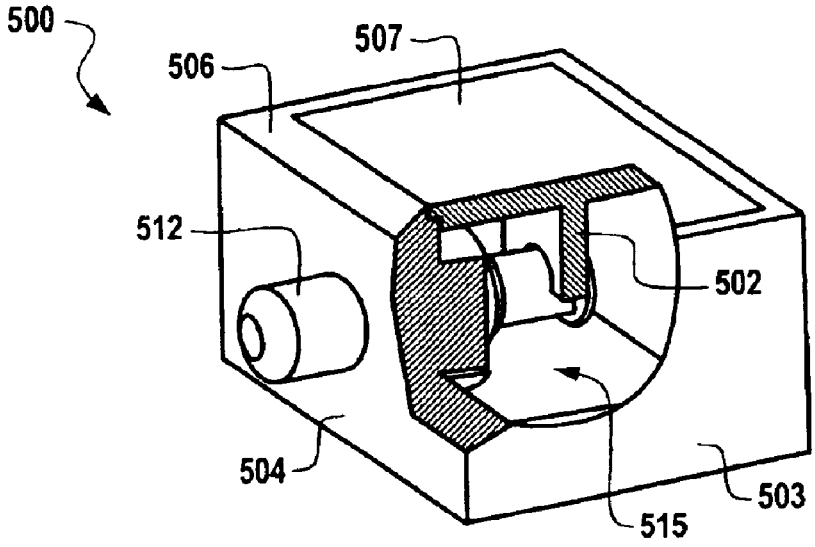
FIG. 23 illustrates a side perspective partial cut-away view of a plunger and a enclosure, in accordance with an alternative embodiment.

In FIGS. 23–29, similar or identical parts are indicated by identical reference numerals. FIG. 23 illustrates a side perspective partial cut-away view of a plunger 512 and an enclosure 500, in accordance with an alternative embodiment. Enclosure 500 includes a wall 503 and a wall 506. A mating cover 507 can be positioned at an opening of wall 506. Cover 507 includes a protruding portion 502 which comes into contact with plunger 512. Wall 503 is located opposite a wall 509, which is identified in FIGS. 24 and 27.

Figure 24:
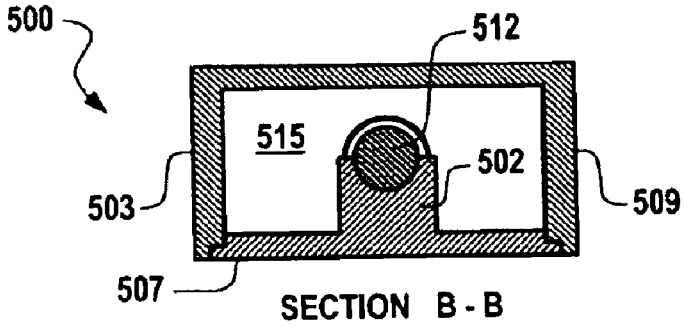
FIG. 24 illustrates a top sectional B—B view of the plunger and the enclosure illustrated in FIG. 23, in accordance with an alternative embodiment.
Figure 25:
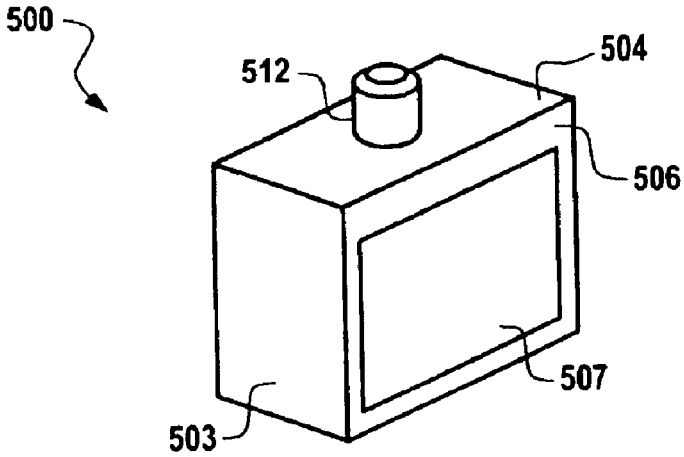
FIG. 25 illustrates a side perspective view of the plunger and the enclosure illustrated in FIG. 23, in accordance with an alternative embodiment.
Figure 26:
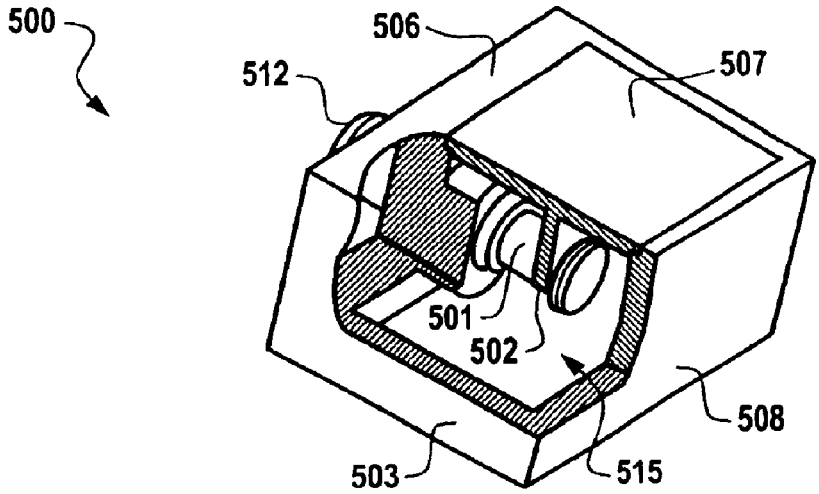
FIG. 26 illustrates a side perspective cut-away view of the plunger and the enclosure illustrated in FIG. 23, in accordance with an alternative embodiment.

FIG. 24 illustrates a top sectional B—B view of the plunger 512 and the enclosure 500 illustrated in FIG. 23, in accordance with an alternative embodiment. In FIG. 24, mating cover 507 and a protruding portion 502 thereof are also shown, along with walls 503 and 509. FIG. 25 illustrates a side perspective view of the plunger 512 and the enclosure 500 illustrated in FIG. 23, in accordance with an alternative embodiment. FIG. 26 illustrates a side perspective cut-away view of the plunger 512 and the enclosure 500 illustrated in FIG. 23, in accordance with an alternative embodiment. In FIG. 26, bottom side or bottom wall 508 is also indicated, which is located opposite top wall or top side 504 depicted in FIG. 23. Plunger 512 is configured to include an undercut portion 501 which can come into contact with the protruding portion 502 of cover 507.

Figure 27:
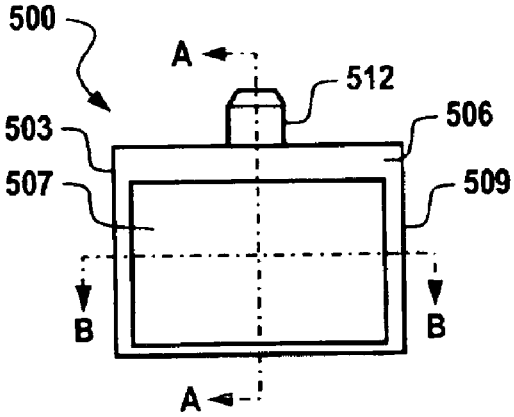
FIG. 27 illustrates a side A—A and B—B view of the plunger and the enclosure illustrated in FIG. 23, in accordance with an alternative embodiment.
Figure 28:
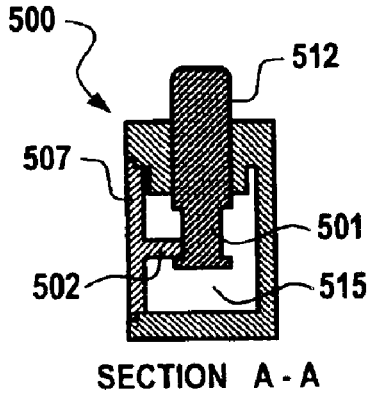
FIG. 28 illustrates a side A—A view of the plunger and the enclosure illustrated in FIG. 23, in accordance with an alternative embodiment.
Figure 29:
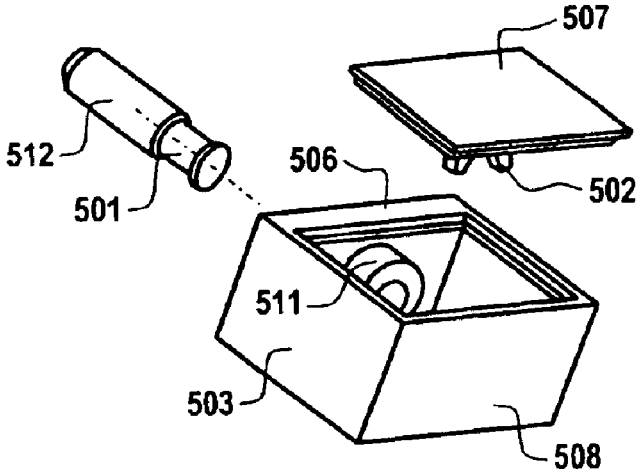
FIG. 29 illustrates an exploded view of the plunger and the enclosure illustrated in FIG. 23, in accordance with an alternative embodiment.

FIG. 27 illustrates a side A—A and B—B view of the plunger 512 and the enclosure 500 illustrated in FIG. 23, in accordance with an alternative embodiment. FIG. 28 illustrates a side A—A view of the plunger 512 and the enclosure 500 illustrated in FIG. 23, in accordance with an alternative embodiment. In FIG. 28, a central portion or cavity 515 of enclosure 500 is further indicated. FIG. 29 illustrates an exploded view of the plunger 512 and the enclosure 500 illustrated in FIG. 23, in accordance with an alternative embodiment. In FIG. 29, bushing 511 is also indicated, along with plunger 512 prior to entry to enclosure 500 and prior to cover 507 coming into contact with plunger 512.

FIGS. 23–29 represent an embodiment that does not require the use of plunger keys or keyways in the bushing of the enclosure. Instead, it requires the plunger 512 to be configured with an undercut portion 501 for a section of its length such that that the diameter of the undercut portion 501 is less than the diameter of the bushing 511. A protruding feature 502 can be configured on or with the mating cover 507, which can then surround the plunger 512 in this undercut section 501 to provide the necessary stop for the plunger 512. The length of the undercut section 501 can be configured such that the appropriate plunger travel is attainable. The configuration depicted in FIGS. 23–29 is advantageous over that described herein with respect to FIGS. 18–22 in cases where the plunger 512 would be machined rather than molded due to the added complexity involved in trying to machine a key into the plunger. It is very easy to machine the undercut section.

Based on the foregoing description, it can be appreciated that embodiments described herein refer to three different methods and configurations for accomplishing the task of retaining the plunger for situations in which the plunger can only be inserted from outside the enclosure due to necessary design constraints. The first method or configuration, FIGS. 12–17, is similar to that of FIGS. 6–11, except that an additional keyway slot is added to the enclosure originating from within the enclosure but not fully extending through the bushing wall to the outside. This additional keyway slot is positioned at some angle such as 90° to the original slot.

The method and configuration of FIGS. 12–17 requires the plunger key (be aligned with the first keyway slot and then the plunger is inserted all the way through the enclosure bushing and then rotated until the plunger key is aligned with the secondary keyway slot. This slot does not fully extend to the outside of the enclosure and thus provides a surface for the plunger key to stop against. The depth of the secondary slot should be slightly longer than the maximum plunger travel to prevent the plunger from being able to rotate back to the point where the plunger key is again aligned with the first keyway slot and can become disengaged from the enclosure.

The second method and configuration is described herein with respect to FIGS. 18–22 and is a modification to FIGS. 12–17. In addition to the keyway slot in the bushing, another slot is provided, which is positioned orthogonal to the plunger/bushing axis. The slot extends to the plunger stop surface at the bottom of the bushing in the enclosure. The mating cover would then include a protruding feature or protruding portion, which fills this second slot and thus prevents the plunger from being able to back out of its intended position even if rotated to align the plunger key with the first slot passing through the entire length of the bushing.

The third and final method and configuration is described herein with respect to FIGS. 23–29, and does not require the use of plunger keys or keyways in the bushing of the enclosure. Instead, it requires the plunger to be undercut for a portion of its length such that the diameter is less than that of the bushing. A protruding feature or protruding portion formed on or from the cover can then surround the plunger in this undercut section and provide the necessary stop for the plunger. The length of the undercut section would be such that the appropriate plunger travel is attainable.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

The embodiments of the invention in which an exclusive property or right is claimed are defined as follows. Having thus described the invention what is claimed is:

1. A switch enclosure apparatus, comprising:

an enclosure having a plurality of walls from which a cavity and at least one slot are formed, wherein at least one wall of said plurality of walls comprises an opening which is covered by a removable mating cover;

a plunger comprising at least one key portion and a shape in a form of a shaft, wherein said plunger is partially located and maintained within said cavity of said enclosure; and at least one slot formed from at least one wall of said enclosure for engaging said at least one key portion of said plunger; and a protruding portion configured from said mating cover for engaging said at least one slot.

2. A switch enclosure apparatus, comprising:

an enclosure having a plurality of walls from which a cavity and at least one slot are formed;

a plunger comprising at least one key portion, wherein said plunger is partially located and maintained within said cavity of said enclosure;

at least one slot formed from at least one wall of said enclosure for engaging said at least one key portion of said plunger; and a bushing formed from said at least one wall of said enclosure, wherein said bushing surrounds said plunger when said plunger is placed into said cavity of said enclosure through an opening of said enclosure.

3. The apparatus of claim 2 wherein said at least one slot comprises a first slot and a second slot, wherein said second slot is positioned at an angle to said first slot, such that said at least one key portion is aligned initially with said first slot and said plunger is thereafter inserted through said bushing, followed by a rotation of said plunger until said at least one key portion is aligned with said second slot, thereby providing a surface to which said plunger stops against.

4. The apparatus of claim 3, wherein said second slot comprises a depth that is longer than a maximum plunger travel of said plunger to prevent said plunger from rotating back to a point where said key portion is aligned with said first slot, thereby preventing disengagement of said plunger from said enclosure.

5. A switch enclosure apparatus, comprising:

an enclosure having a plurality of walls from which a cavity and at least one slot are formed;

a plunger comprising an undercut portion, wherein said plunger is formed in the shape of a shaft and is partially located and maintained within said cavity of said enclosure; and a removable mating cover for engaging said enclosure at an opening formed from at least one side wall of said plurality of walls, wherein said cover comprises a protruding portion which surrounds and engages said plunger at said undercut portion, thereby providing a stop for said plunger to prevent said plunger from disengaging from said enclosure.

6. The apparatus of claim 5, wherein at least one wall of said plurality of walls comprises a circular opening through which a portion of said plunger protrudes from said enclosure.

7. The apparatus of claim 6 wherein said plurality of walls of said enclosure comprises a top wall, a bottom wall and four side walls, wherein said circular opening is formed from said top wall such that said circular opening forms a portion of a bushing formed from said top wall of said enclosure.

8. A switch enclosure method, comprising:

providing an enclosure having a plurality of walls from which a cavity and at least one slot are formed;

forming an opening from at least one wall of said plurality of walls, wherein said opening is covered by a removable mating cover;

locating a portion of a plunger within said enclosure, wherein said plunger comprises a form of a shaft and at least one key portion, wherein said plunger is partially located and maintained within said cavity of said enclosure;

engaging at least one slot formed from at least one wall of said enclosure with said at least one key portion of said plunger; and providing a protruding portion configured from said mating cover for engaging said at least one slot.

9. A switch enclosure method, comprising:

providing an enclosure having a plurality of walls from which a cavity and at least one slot are formed;

locating a portion of said plunger within said enclosure, wherein said plunger comprises at least one key portion, wherein said plunger is partially located and maintained within said cavity of said enclosure;

engaging at least one slot formed from at least one wall of said enclosure with said at least one key portion of said plunger; and providing a bushing formed from said at least one wall of said enclosure, wherein said bushing surrounds said plunger when said plunger is placed into said cavity of said enclosure through an opening of said enclosure.

10. The method of claim 9 wherein said at least one slot comprises a first slot and a second slot.

11. The method of claim 10 further comprising:

positioning said second slot at an angle to said first slot;

aligning that said at least one key portion with said first slot thereafter inserting said plunger through said bushing; and thereafter rotating said plunger until said at least lone key portion is aligned with said second slot, thereby providing a surface to which said plunger stops against.

12. The method of claim 11 wherein said second slot comprises a depth that is longer than a maximum plunger travel of said plunger to prevent said plunger from rotating back to a point where said key portion is aligned with said first slot, thereby preventing disengagement of said plunger from said enclosure.

13. The method of claim 9 further comprising:

configuring said plunger to comprise an undercut portion;

engaging said undercut portion of said plunger with a protruding portion of said cover which surrounds said undercut portion of said plunger to maintain said plunger within said enclosure.

14. The method of claim 13 wherein said protruding portion of said plunger extends from said cover in a direction perpendicular to said cover.

* * * * *